US006817938B1

(12) United States Patent
Sorensen et al.

(10) Patent No.: US 6,817,938 B1
(45) Date of Patent: Nov. 16, 2004

(54) COIN HOLDER AND DISPENSER ADAPTED FOR USE WITH A COIN-OPERATED SLOT MACHINE

(76) Inventors: Jon J. Sorensen, P.O. Box 774, Kirbyville, TX (US) 75956; George S. Withrow, R.R. 4, Box 32A, Kirbyville, TX (US) 75956

( * ) Notice: Subject to any disclaimer, the term of this patent is extended or adjusted under 35 U.S.C. 154(b) by 0 days.

(21) Appl. No.: 10/660,430

(22) Filed: Sep. 12, 2003

(51) Int. Cl.[7] ..... G07D 1/00

(52) U.S. Cl. ..... 453/54; 453/48; 453/53; 453/54; 453/61

(58) Field of Search ..... 194/353; 453/48, 453/50, 52–54, 61–63

(56) References Cited

U.S. PATENT DOCUMENTS 497,059 A * 5/1893 Ramey ..... 453/49
1,011,272 A * 12/1911 Teeter et al. ..... 453/48
1,160,255 A 11/1915 Buchrim
2,443,862 A * 6/1948 Justus ..... 221/279
3,731,695 A 5/1973 Meijer
4,462,414 A * 7/1984 Gordon ..... 453/44
4,874,348 A 10/1989 Lafreniere et al.
4,884,992 A * 12/1989 Grimes ..... 453/29
4,902,263 A 2/1990 Ito et al.
5,387,152 A * 2/1995 Packer et al. ..... 453/52
5,492,504 A 2/1996 Wolters

* cited by examiner

*Primary Examiner*—Donald P. Walsh
*Assistant Examiner*—Jeffrey Shapiro
(74) *Attorney, Agent, or Firm*—Donald R. Schoonover

(57) ABSTRACT

A coin holder and dispenser holds coins for use with a slot machine and is used to easily and efficiently dispense coins directly into the coin slot of the slot machine.

2 Claims, 3 Drawing Sheets

COIN HOLDER AND DISPENSER ADAPTED FOR USE WITH A COIN-OPERATED SLOT MACHINE

BACKGROUND OF THE INVENTION

1. Field of the Invention

The present invention relates to the general art of coin handling, and to the particular field of coin holders for dispensing single coins.

2. Discussion of Background Information

Many people enjoy playing slot machines. In most cases, the player is required to store coins for use with the slot machines. Such coin storage can be cumbersome and inconvenient.

Therefore, there is a need for a means to store and dispense coins that can be used for a slot machine in a convenient manner.

Many slot machines require the player to deposit a coin into the coin slot of the machine. Since many players tend to play a slot machine for great lengths of time, the repeated movement of removing a coin from a storage container and then placing the coin into the slot of the machine may be tiring and difficult, especially if the person is disabled.

Therefore, there is a need for a means to store and dispense coins that can be used for a slot machine and which can be used in an easy and convenient manner.

While the art contains devices which can hold and dispense coins, many of these known devices do not automatically dispense coins in a manner which is convenient and efficient for use with a slot machine.

Therefore, there is a need for a means to store and dispense coins that can be used for a slot machine and which can efficiently store coins for use and which can easily and efficiently dispense those coins directly into the coin slot of the slot machine whereby long use of a slot machine, even for a disabled person, is facilitated.

PRINCIPAL OBJECTS OF THE INVENTION

It is It is a main object of the present invention to provide a means to store and dispense coins that can be used for a slot machine in a convenient manner.

It is another object of the present invention to provide a means to store and dispense coins that can be used for a slot machine and which can be used in an easy and convenient manner.

It is specific object of the present invention to provide a means to store and dispense coins that can be used for a slot machine and which can efficiently store coins for use and which can easily and efficiently dispense those coins directly into the coin slot of the slot machine whereby long use of a slot machine, even for a disabled person, is facilitated.

SUMMARY OF THE INVENTION

These, and other, objects are achieved by a coin holder and dispenser for use in conjunction with a coin-operated slot machine which comprises a coin holder unit which includes a cylindrical base element having a first end, a second end, an axial dimension, an inner surface, an outer surface, a cylindrical wall connecting the first end to the second end, a coin-dispensing slot defined through the wall near the second end of the base element, the coin-dispensing slot having a first edge extending radially of the cylindrical wall, and a second edge which extends at an oblique angle with respect to the first edge and with respect to the axial dimension; a plunger slidably located inside the coin holder unit; an outer shell unit which accommodates the wall of the coin holder unit when in use, the outer shell unit including a handle having a distal end, the distal end of the handle being movable between a retracted position and a coin-dispensing position; a spring element located insde the wall of the coin holder unit and inside the outer shell unit, the spring element having one end abutting the outer shell unit and one end abutting the plunger and biasing the plunger toward the second end of the base element in the direction of the axial dimension of the base element; a coin-dispensing plunger slidably mounted on the outer shell unit, the coin-dispensing plunger including a hole which is located to releasably accommodate the distal end of the handle of the outer shell unit to releasably lock the coin-dispensing plunger to the handle of the outer shell unit to move therewith, the plunger being slidable between a retracted position and a coin-dispensing position when the distal end of the handle is moved between the retracted position and the coin-despensing position; a lock unit releasably locking the outer shell unit to the coin holder unit when the lock unit is engaged, the lock unit including a groove defined in the base element, a lever element pivotally mounted on the outer shell unit, and a tooth on the lever element; and the coin holder unit being adapted to accommodate a plurality of coins in engaging contact with the plunger and having one coin located adjacent to the coin-dispensing slot to be deposited in a coin-accepting slot of a coin-operated slot machine under the influence of the spring element and under the influence of the coin-dispensing plunger as the distal end of the handle is moved from the retracted position of the distal end to the coin-dispensing position of the handle.

The device embodying the present invention provides a means to store and dispense coins that can be used for a slot machine and which can efficiently store coins for use and which can easily and efficiently dispense those coins directly into the coin slot of the slot machine whereby long use of a slot machine, even for a disabled person, is facilitated.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 2:
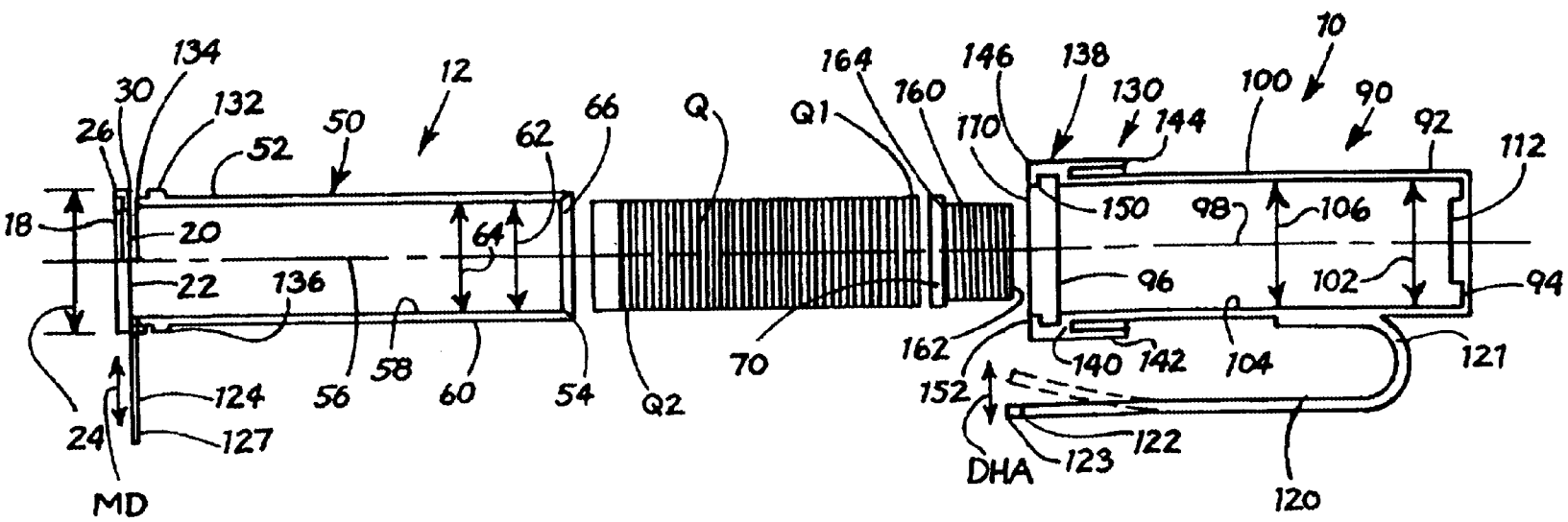
FIG. 2 is an exploded elevational view of the coin holder and dispenser embodying the present invention.
Figure 4A:
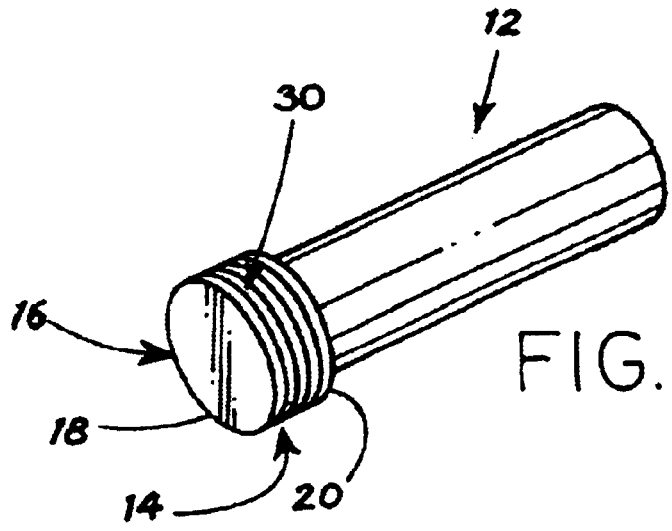
FIG. 4A is a perspective view of a coin holder unit which is included in the coin holder and dispenser embodying the present invention.
Figure 4B:
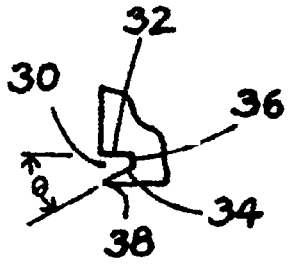
FIG. 4B is a view of a dispensing slot which is included in the coin holder and dispenser embodying the present invention.

Referring to the figures, it can be understood that the present invention is embodied in a coin holder and dispenser 10 which is adapted for use in conjunction with a coin-operated slot machine. The holder and dispenser 10 comprises a coin holder unit 12 which is shown in FIGS. 2 and 4A and which includes a base element 14. Base element 14 includes a hollow cylindrical base portion 16 having a first end 18, a second end 20, and an axial dimension 22 which extends between the first end 18 of the base portion 14 and the second end 20 of the base portion 14. The base portion 14 further includes an outer dimension 24 and a cylindrical side wall 26 connecting the first end 18 of the base portion 14 to the second end 20 of the base portion 16. A coin-dispensing slot 30 is defined through the side wall 26 of the base portion 14 near the first end 18 of the base portion 14. As best shown in FIG. 4B, the coin-dispensing slot 30 extends radially of the cylindrical base portion 16. Coin-dispensing slot 30 includes a first edge 32 which extends radially of the cylindrical base portion 16 and a second edge 34. Second edge 34 is spaced apart from the first edge 32 in the direction of the axial dimension 22 of the base portion 16. The second edge 34 extends at an oblique angle, θ, with respect to the first edge 32 and with respect to the axial dimension 22 of the base portion 14. The second edge 34 includes a first end 36 and a second end 38 with the second end 38 of the second edge 34 being located closer to the second end 20 of the base portion 16 than the first end 36 of the second edge 34.

A hollow cylindrical body portion 50 has a first end 52, a second end 54, and a longitudinal axis 56 which extends between the first end 52 of the body portion 50 and the second end 54 of the body portion 50. The body portion 50 further includes an inner surface 58, an outer surface 60, an outer dimension 62, and an inner dimension 64. The outer dimension 24 of the base portion 16 is larger than the outer dimension 62 of the body portion 50. The hollow cylindrical body portion 50 is adapted to accommodate a plurality of coins.

The base portion 16 is unitary with the body portion 50 and is located adjacent to the first end 52 of the body portion 50. The body portion 50 has an access opening 66 defined therein adjacent to the second end 54 of the body portion 50.

Figure 5:
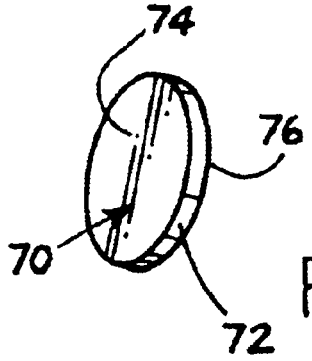
FIG. 5 is a perspective view of a plunger which is included in the coin holder and dispenser embodying the present invention.
Figure 6:
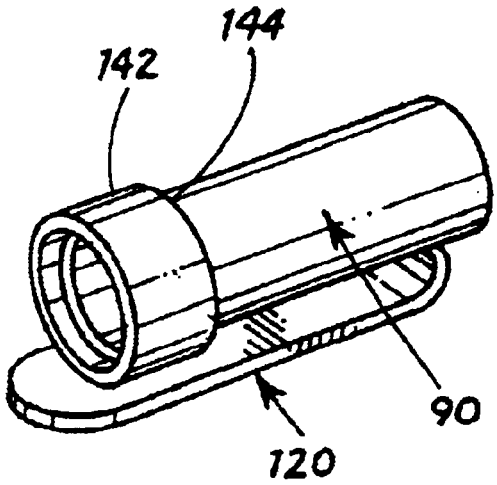
FIG. 6 is a perspective view of an outer shell unit which is included in the coin holder and dispenser embodying the present invention.

A cylindrical plunger 70 is shown in FIG. 5 and has an arcuate outer circumference 72 which is slightly smaller than inner dimension 64 of the body portion 50. The plunger 70 has a first surface 74 and a second surface 76. In use, the plunger 70 is slidably received in the body portion 50 to move along the longitudinal axis 56 of the body portion 50 between a first position adjacent to the second end 54 of the body portion 50 and a second position adjacent to the first end 52 of the body portion 50. The first position of the plunger 70 is shown in FIG. 3.

Figure 1:
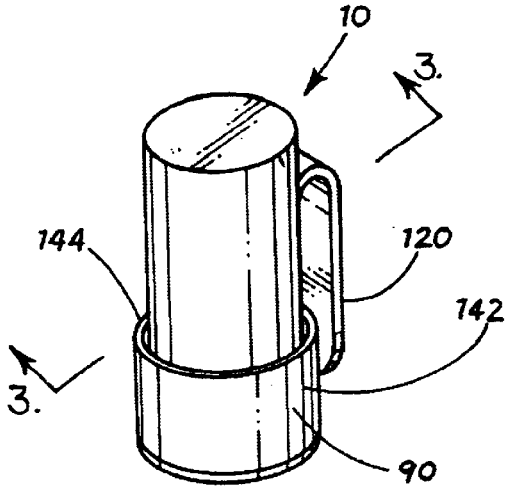
FIG. 1 is a perspective view of a coin holder and dispenser embodying the present invention.

An outer shell unit 90 is shown in FIGS. 1 and 2 and includes a hollow cylindrical body element 92 which has a closed first end 94, a second end 96, and a longitudinal axis 98 which extends between the first end 94 of the outer shell unit 90 and the second end 96 of the outer shell unit 90. The shell unit 90 further includes an outer surface 100 having an outer dimension 102 and an inner surface 104 having an inner dimension 106. The inner dimension 106 of the body element 92 of the outer shell unit 90 is larger than the outer dimension 62 of the body portion 50 of the coin holder unit 12 so the coin holder unit 12 can be accommodated inside the outer shell unit 90 as shown in FIG. 3. The body element 92 of the outer shell unit 90 further includes an access opening 110 defined in the second end 96 of the body element 92 of the shell unit 90. A spring seat element 112 is located on the closed first end 94 of the body element 92 of the outer shell unit 90.

An outer clip 120 is on the outer surface 100 of the body element 92 of the outer shell unit 90. The outer clip 120 includes a proximal end 121 connected to the outer shell unit 90 and a distal end 122, and has a triangular projection 123 on the outer clip 120 adjacent to the distal end 122. As indicated by double-headed arrow DHA, the outer clip 120 is movably mounted on the outer shell unit 90 to move between a coin-dispensing position indicated in dotted lines in FIG. 2, with the distal end 122 of the outer clip 120 located adjacent to the outer shell unit 90 and a retracted position shown in solid lines in FIG. 2, with the distal end 122 of the outer clip 120 spaced apart from the outer shell unit 90.

Figure 3:
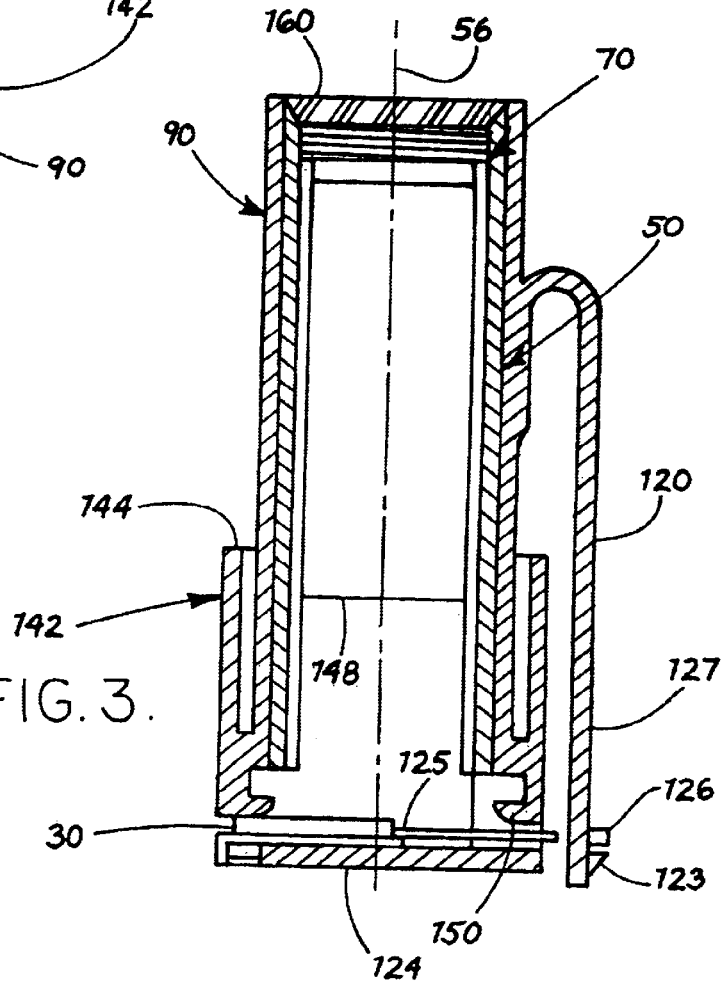
FIG. 3 is an elevational view taken along line 3—3 of FIG. 1.

In use, the body portion 50 of the coin holder unit 12 is slidably received in the body element 92 of the outer shell unit 90, as shown in FIG. 3.

A coin-moving plunger 124 is slidably mounted on hollow cylindrical body portion 50 to move as indicated by double-headed arrow MD between a coin-dispensing position shown in dotted lines in FIG. 3 and a retracted position shown in solid lines in FIG. 3. Plunger 124 includes a distal end 125, which is located to abut a coin located adjacent to dispensing slot 30 and force that coin out of the slot 30 when the outer clip 120 is moved into the coin-dispensing position, and a proximal end 126. A hole 127 is defined through plunger 124 and accommodates the distal end 122 of the outer clip 120 to connect the outer clip 120 to the plunger 124. The triangular shape of projection 123 permits the outer clip 120 to be attached to the plunger 124 and to be released from the plunger 124 by holding the plunger 124 while moving the outer clip 120 to release the projection 123 from the plunger 124. The release of the outer clip 120 from the plunger 124 permits the outer shell 90 to be removed from the body portion 50 so the device 10 can be opened to load coins therein to. The coin-moving plunger 124 can be plate-like in shape.

A lock unit 130 releasably locks the coin holder unit 12 to the outer shell unit 90 when the lock 130 is engaged as shown in FIG. 3. The lock unit 130 includes a base section 132 on the outer surface 60 of the cylindrical body portion 50 of the coin holder. Unit 12 adjacent to the slot 30, a catch groove 134 defined in the base section 132 of the lock unit 130, and a shoulder 136 on the base section 132.

A catch element 138 is mounted on the outer surface 100 of the body element 92 of the outer shell unit 90 adjacent to the second end 96 of the body element 92 of the outer shell unit 90. Catch element 138 includes a pivot element 140, mounted on the body element 92 of the outer shell unit 90, and a lever element 142. Lever 142 has a first end 144 and a second end 146, and is connected to the pivot element 140. As can be understood from the foregoing, lever element 138 is a first class lever. The lever element 138 forms a cylinder with an inner dimension 148 that is larger than the outer dimension 102 of the body element 92 of the outer shell unit 90. The lever element 138 is in surrounding relation with the body element 92 of the outer shell unit 90.

A catch tooth 150 is on the second end 144 of the lever element 142. The catch tooth 150 includes a leading shoulder 152 that is adapted to engage shoulder 136 on the base section 132 when the lock element 130 is being engaged to releasably lock the coin holder unit 12 to the outer shell unit 90.

The lever element 142 is mounted on the outer surface 100 of the body element 92 of the outer shell unit 90 by the pivot element 140 to pivotally move between a first orientation, shown in FIG. 3, with the catch tooth 150 located adjacent to a location which is in a surface containing the outer surface 100 of the body element 92 of the outer shell unit 90 and a second orientation with the catch element 138 in a location spaced apart from the location which is in a surface containing the outer surface 100 of the body element 92 of the outer shell unit 90.

As can be understood from FIG. 3, the second end 146 of the lever element 142 moves between a first location adjacent to the outer surface 100 of the body 92 of the outer shell unit 90 when the lever element 142 is in the second position thereof.

As can be understood from the foregoing, the leading shoulder 152 of the catch tooth 150 is located to slidingly abut the shoulder 136 of the lock unit 130 to move the lever element 142 toward the second orientation thereof as the lock unit 130 is moved into a position to releasably lock the coin holder unit 12 to the outer shell unit 90 from a position in which the coin holder unit 12 is unlocked from the outer shell unit 90.

As shown in FIG. 3, the catch tooth 150 is located in the catch groove 134 when the lever element 142 is in the first orientation thereof and the lock element 130 is engaged. The catch tooth 150 is spaced apart from the catch groove 134 when the lever element 142 is in the second orientation thereof.

A spring element 160 is located inside the hollow cylindrical body element 92 of the outer shell unit 90. Spring element 160 includes a first end 162 which is in abutting contact with the inner surface 104 of the hollow body element 92 of the outer shell unit adjacent to the spring seat element 112 on the hollow body element 92 of the outer shell unit 90 when the spring element 160 is in a use condition as shown in FIG. 3. Spring element 160 further is includes a second end 164 which is in abutting contact with the first surface 74 of the plunger 70 in a use condition of the spring element 160. The spring element 160 biases the plunger 70 towards the second position of the plunger 70.

The coin holder unit 12 is sized and adapted to slidingly contain a plurality of coins, such as quarters Q shown in FIG. 2, with one coin Q1 of the plurality of coins in abutting contact with the second surface 76 of the plunger 70 and at least one coin Q2 of the plurality of coins located adjacent to the coin-dispensing slot 30 defined through the side wall 26 of the base portion 16 of the coin holder unit 12. Coin-dispensing slot 30 is sized and adapted to have the at least one coin slide through the slot 30 along the second edge 34 of coin-dispensing slot 30 into a coin-accepting slot of a coin-operated slot machine under the influence of the bias of the spring element 160 when the handle is moved into the coin-dispensing position and the plunger 70 abuts the one coin to move the one coin through the coin-dispensing slot 30 when the handle is moved into the coin-dispensing position.

It is understood that while certain forms of the present invention have been illustrated and described herein, it is not to be limited to the specific forms or arrangements of parts described and shown.

What is claimed and desired to be covered by Letters Patent is:

1. A coin holder and dispenser for use in conjunction with a coin-operated slot machine comprising:

a) a coin holder unit which includes (1) a base element which includes a hollow cylindrical base portion having a first end, a second end, an axial dimension which extends between the first end of the base portion and the second end of the base portion, an oute dimension, a cylindrical side wall connecting the first end of the base portion to the second end of the base portion, a coin-dispensing slot defined through the side wall of the base portion near the first end of the base portion, the coin-dispensing slot extending radially of the cylindrical base portion and including (A) a first edge which extends radially of the cylindrical base portion, and (B) a second edge, the second edge being spaced apart from the first edge in the direction of the axial dimension of the base portion, the second edge extending at an oblique angle with respect to the first edge and with respect to the axial dimension of the base portion, the second edge including a first end and a second end with the second end of the second edge being located closer to the second end of the base portion than the first end of the second edge, (2) a hollow cylindrical body portion having a first end, a second end, a longitudinal axis extending between the first end of the body portion and the second end of the body portion, an inner surface, an outer surface, an outer dimension, and an inner dimension, the hollow cylindrical body portion being adapted to accommodate a plurality of coins, (3) the outer dimension of the base portion being larger than the outer dimension of the body portion, (4) the base portion being unitary with the body portion and being located adjacent to he first end of the body portion, and (5) the body portion having an access opening defined therein adjacent to the second end of the body portion;

b) a cylindrical plunger which has an arcuate outer circumference, the outer circumference of the plunger being slightly smaller than the inner dimension of the body portion, the plunger having a first surface and a second surface and in use being slidably received in the body portion to move along the longitudinal axis of the body portion between a first position adjacent to the second end of the body portion and a second position adjacent to the first end of the body portion;

c) an outer shell unit which includes (1) a hollow cylindrical body element which has a closed first end, a second end, a longitudinal axis extending between the first end of said outer shell unit and the second end of said outer shell unit, an outer surface having an outer dimension and an inner surface having an inner dimension, the inner dimension of the body element of said outer shell unit being larger than the outer dimension of the body portion of said coin holder unit, the body element of said outer shell unit further including an access opening defined in the second end of the body element of said shell unit, and a spring seat element on the closed first end of the body element of said outer shell unit, (2) an outer clip on the outer surface of the body element of said outer shell unit, the outer clip including a proximal end connected to the outer shell unit, a distal end and having a triangular shaped projection on the outer clip adjacent to the distal end, the outer clip being movably mounted on the outer shell unit to move between a coin-dispensing position with the distal end of the outer clip located adjacent to the outer shell unit and a retracted position with the distal end of the outer clip located spaced apart from the outer shell unit, and (3) the body portion of said coin holder unit being slidably received in the body element of said outer shell unit in use;

d) a coin-moving plunger slidably mounted on the hollow cylindrical body portion to move between a coin-dispensing position and a retracted position, the coin-dispensing plunger including a distal end which is located to abut a coin located adjacent to the dispensing slot and force that coin out of the coin-dispensing slot when the outer clip is moved into the coin-dispensing position, the handle further including a proximal end, a hole defined through the plunger and sized to accommodate the distal end of the outer clip to connect the outer clip to the plunger, the projection being triangular in shape and sized to permit the outer clip to be attached to the plunger and to be released from the plunger;

e) a lock unit releasably locking said coin holder unit to said outer shell unit when said lock is engaged, said lock unit including (1) a base section on the outer surface of the cylindrical body portion of said coin holder unit adjacent to the slot, (2) a catch groove defined in the base section of said lock unit, (3) a shoulder on the base section, (4) a catch element mounted on the outer surface of the body element of said outer shell unit adjacent to the second end of the body element of said outer shell unit, the catch element including (A) a pivot element mounted on the body element of said outer shell unit, (B) a lever element having a first end and a second end and being connected to the pivot element, the lever element forming a cylinder with an inner dimension that is larger than the outer dimension of the body element of said outer shell unit, the lever element being in surrounding relation with the body element of said outer shell unit, (C) a catch tooth on the first end of the lever element, the catch tooth including a leading shoulder that is adapted to engage the shoulder on the base section when said lock element is being engaged to releasably lock said coin holder unit to said outer shell unit, (D) the lever element being mounted on the outer surface of the body element of said outer shell unit by the pivot element to pivotally move between a first orientation with the catch tooth being located adjacent to a location which is in a surface containing the outer surface of the body element of said outer shell unit and a second orientation with the catch element being in a location spaced apart from the location which is in a surface containing the outer surface of the body element of said outer shell unit (E) the second end of the lever element moving between a first location adjacent to the outer surface of the body of said outer shell unit when the lever element is in the second position thereof, (F) the leading shoulder of the catch tooth being located to slidingly abut the shoulder of said lock unit to move the lever element toward the second orientation thereof as said lock unit is moved into a position to releasably lock said coin holder unit to said outer shell unit from a position in which said coin holder unit is unlocked from said outer shell unit, and (G) the catch tooth being located in the catch groove when the lever element is in the first orientation thereof and said lock element is engaged, the catch tooth being spaced apart from the catch groove when the lever element is in the second orientation thereof;

f) a spring element located inside the hollow cylindrical body element of said outer shell unit and including a first end in abutting contact with the inner surface of the hollow body element of said outer shell unit adjacent to the spring seat element on the hollow body element of said outer shell unit and a second end which is in abutting contact with the first surface of said plunger in a use condition of said spring element, said spring element biasing said plunger towards the second position of said plunger; and g) said coin holder unit being sized and adapted to, in use, slidingly contain a plurality of coins with one of the plurality of coins being in abutting contact with the second surface of said plunger and at least one coin of said plurality of coins being located adjacent to the coin-dispensing slot defined through the side wall of the base portion of said coin holder unit, the coin-dispensing slot being sized and adapted to have the at least one coin slide through the coin-dispensing slot along the second edge of the coin-dispensing slot into a coin-accepting slot of a coin-operated slot machine under the influence of the bias of said spring element when the handle is moved into the coin-dispensing position and the plunger abuts the one coin to move the one coin through the coin-dispensing slot when the handle is moved into the coin-dispensing position.

2. A coin holder and dispenser for use in conjunction with a coin-operated slot machine comprising:

a) a coin holder unit which includes (1) a cylindrical base element having a first end, a second end, an axial dimension, an inner surface, an outer surface, a cylindrical wall connecting the first end to the second end, a coin-dispensing slot defined through the wall near the second end of said base element, the coin-dispensing slot having (A) a first edge extending radially of the cylindrical wall, and (B) a second edge which extends at an oblique angle with respect to the first edge and with respect to the axial dimension;

b) a plunger slidably located inside said coin holder unit;

c) an outer shell unit which accommodates the wall of said coin holder unit when in use, said outer shell unit including a handle having a distal end, the distal end of the handle being movable between a retracted position and a coin-dispensing position;

d) a spring element located inside the wall of said coin holder unit and inside the outer shell unit, said spring element having one end abutting said outer shell unit and one end abutting said plunger and biasing said plunger toward the second end of said base element in the direction of the axial dimension of the base element;

e) a coin-dispensing plunger slidably mounted on said outer shell unit, said coin-dispensing plunger including a hole which is located to releasably accommodate the distal end of the handle of said outer shell unit to releasably lock said coin-dispensing plunger to the handle of said outer shell unit to move therewith, said plunger being slidable between a retracted position and a coin dispensing position when the distal end of the handle is moved between the retracted position and the coin-dispensing position;

f) a lock unit releasably locking said outer shell unit to said coin holder unit when said lock unit is engaged, said lock unit including a groove defined in the base element, a lever element pivotally mounted on said outer shell unit, and a tooth on the lever element; and g) said coin holder unit being adapted to accommodate a plurality of coins in engaging contact with said plunger and having one coin located adjacent to the coin-dispensing slot to be deposited in a coin-accepting slot of a coin-operated slot machine under the influence of said spring element and under the influence of said coin-dispensing plunger as the distal end of the handle is moved from the retracted position of the distal end to the coin-dispensing position of the handle.

* * * * *